United States Patent [19]

Miley

[11] Patent Number: 4,945,846

[45] Date of Patent: Aug. 7, 1990

[54] SHOCK ABSORBER UNIT FOR SAILBOARDS

[76] Inventor: Bradford A. Miley, R.D. 2, Box 188, Durham Rd., Ottsville, Pa. 18942

[21] Appl. No.: 316,419

[22] Filed: Feb. 27, 1989

[51] Int. Cl.[5] ..... B63B 15/02

[52] U.S. Cl. ..... 114/90; 114/39.2; 441/74; 188/298

[58] Field of Search ..... 114/39.1, 39.2, 89–91; 441/65, 74; 248/562, 566, 636; 188/266, 269, 297, 298, 302, 303, 306, 309, 327.11, 327.13, 327.15, 327.19, 322.21, 299

[56] References Cited

U.S. PATENT DOCUMENTS

| | | | |
|---|---|---|---|
| 3,081,847 | 3/1963 | Smitley | 188/298 |
| 3,154,273 | 10/1964 | Paulsen | 188/298 |
| 3,189,133 | 6/1965 | Dillenburger | 188/298 |
| 4,037,553 | 7/1977 | Marker | 114/91 |
| 4,073,254 | 2/1978 | Marker | 114/90 |
| 4,166,425 | 9/1979 | Kummetz | 114/39 |
| 4,236,476 | 12/1980 | Solf et al. | 114/91 |
| 4,271,938 | 6/1981 | Berger | 188/280 |
| 4,276,848 | 7/1981 | Marker | 114/91 |
| 4,319,535 | 3/1982 | Schweitzer et al. | 114/91 |
| 4,331,094 | 5/1982 | Drexler | 114/90 |
| 4,418,895 | 12/1983 | Bertin | 188/298 |
| 4,455,959 | 6/1984 | Suzuki | 114/90 |
| 4,462,327 | 7/1984 | Pertramer et al. | 114/90 |
| 4,466,375 | 8/1984 | Marker | 114/90 |
| 4,526,120 | 7/1985 | Gaide | 114/39 |
| 4,635,578 | 1/1987 | Calcabrini et al. | 114/39 |
| 4,649,847 | 3/1987 | Tinkler et al. | 114/39 |
| 4,790,520 | 12/1988 | Tanaka | 188/298 |

OTHER PUBLICATIONS

Manual: Firestone Airstroke Actuators/Airstroke Isolators, *Engineering Manual and Design Guide*, pp. 1–7, 14–31, 71, 100 (1986).

Advertisement: "Fleetwood Precision Hardward", pp. 1, 4.

Advertisement: "Smooth Ride", 19 *Wind Surf*, 77 (Mar. 1989).

*Primary Examiner*—Joseph F. Peters, Jr.
*Assistant Examiner*—Clifford T. Bartz
*Attorney, Agent, or Firm*—Ferrill and Logan

[57] ABSTRACT

The present invention provides a shock absorber unit for use on sailboards to absorb detrimental vertical forces generated during sailing in rough water. The unit replaces existing flexible solid rubber universal joints with a joint comprising a pressurized chamber with a flexible side wall. The flexibility of the side wall allows the present invention to absorb the impact forces while serving as an improved universal joint.

20 Claims, 3 Drawing Sheets

FIG. 1
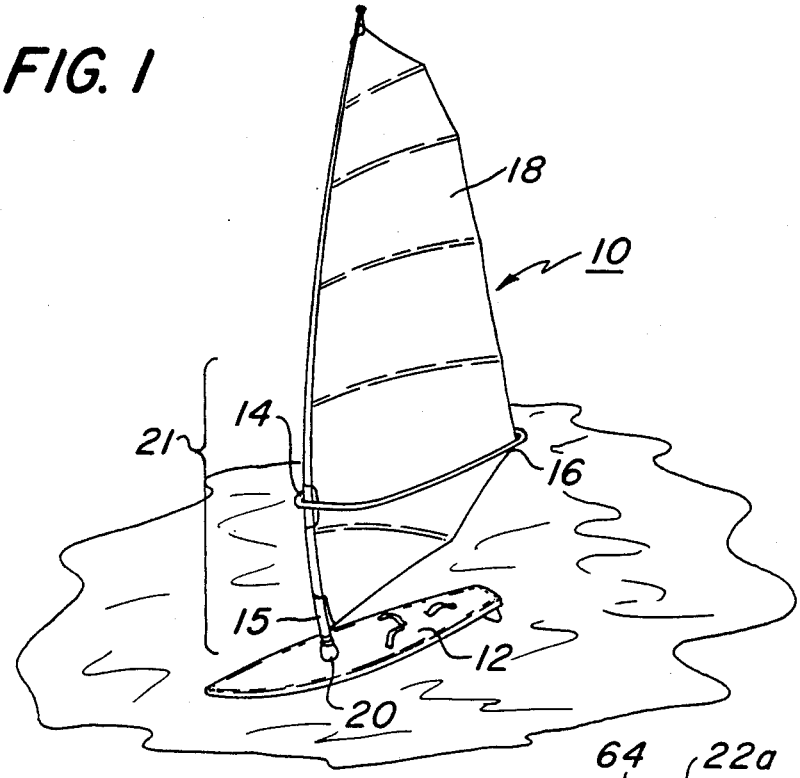
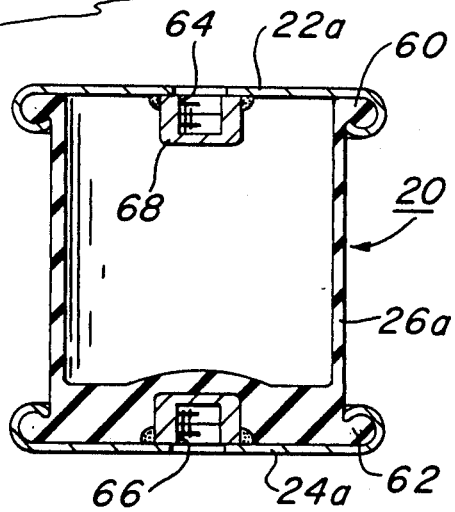
FIG. 6
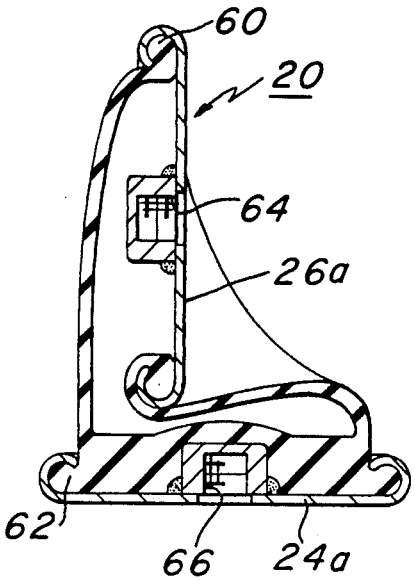
FIG. 7

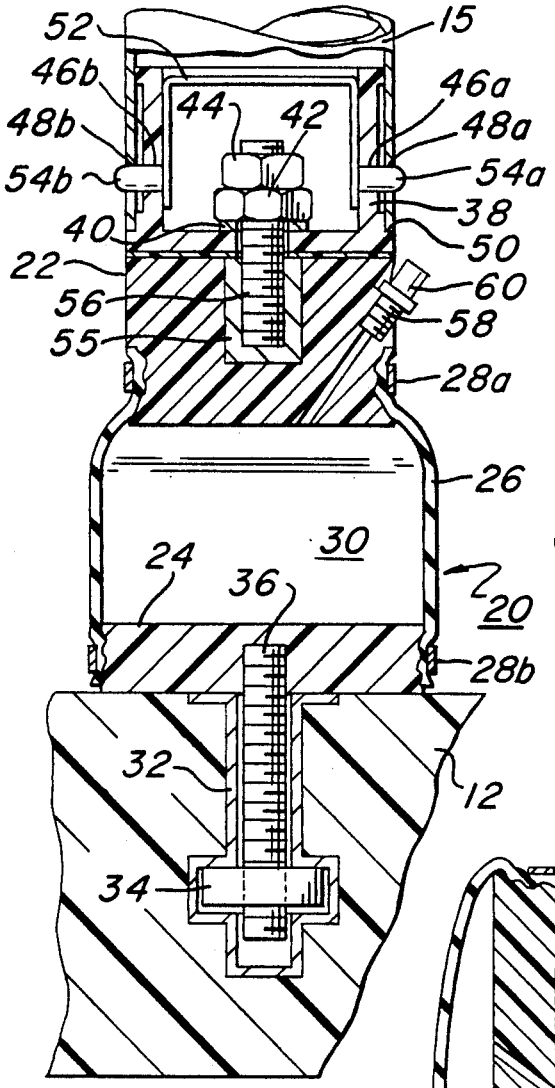
FIG. 3
FIG. 4
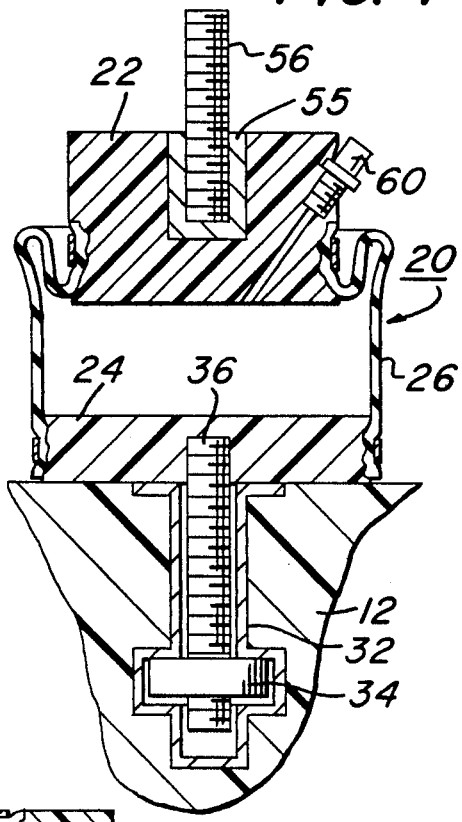
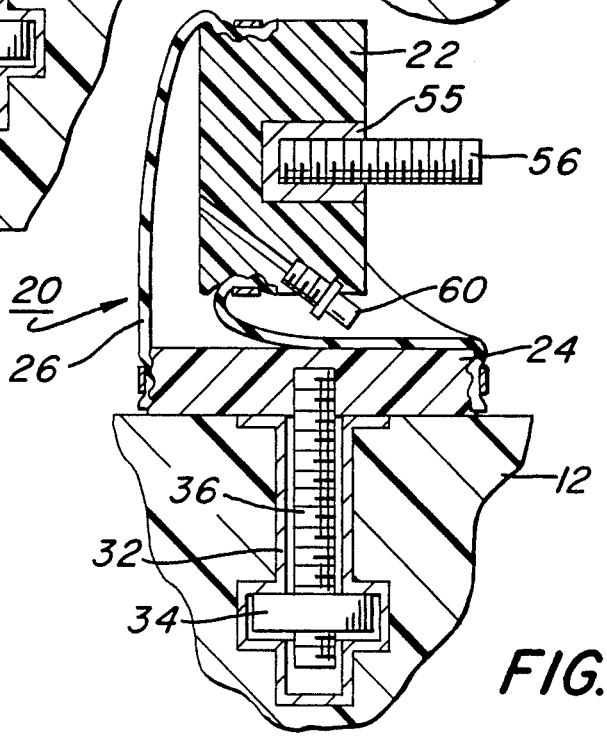
FIG. 5

SHOCK ABSORBER UNIT FOR SAILBOARDS

BACKGROUND OF THE INVENTION

1. Field of the Invention

The present invention relates to sailboards, universal joints for flexibly mounting rigs onto sailboards, and means to absorb vertical forces of a sailboard rig against a sailboard in choppy water.

2. Description of the Prior Art

In a conventional sailboard, the rig, which usually comprises a base cup, a mast base, a mast, a boom, and a sail, is attached to the board by a universal joint which permits the rig to be rotated a full 360° with respect to the board. The conventional universal joint includes a concave cylinder of solid rubber which permits the rig to pivot anywhere from perpendicular to the plane of the board to parallel to the board. As is well accepted, this pivoting between rig and the board is essential to the basic operation of the sailboard. However, solid rubber universal joints are prone to failure due to the tendency of the rubber to "age" rapidly when exposed to sun, sand, and salt water and to wear and break as a result of the stresses placed upon them. Naturally, this tendency toward joint failure is increased under the increased stresses of rough water conditions.

Further, it is known that sailboards experience loss of efficiency in choppy water or after jumps due to essentially vertical forces created by the rig weight relative to the board. Basically, the vertical movement of the board causes the rig to move up and down. The absence of means to absorb the vertical forces of the rig creates a number of undesirable effects. First, the mast tends to flex to absorb these forces. This bending of the mast alters the trim of the sail and "spills" wind—thus decreasing the efficiency of the sailboard. Second, the downward forces of the rig causes deflection of the hull (i.e. the shape of the board itself alters to absorb impact), again diminishing efficiency. Finally, the constant jarring of choppy water places substantial stresses upon the rig, universal joint and board, which tends to significantly decrease the life of the sailboard equipment.

In response to these problems, one solution suggested is to incorporate a piston shock absorber unit into the mast or mast base itself which could absorb the forces of impact. The present inventor is unaware of any commercial embodiment of such a unit. One major problem with this approach is that the forces of impact are not always directed axially along a sailboard mast—especially during jumps or in rough water where the rig is often positioned at skewed angles with respect to the board. Accordingly, this shock absorber cannot absorb all the undesirable forces and the unit itself is necessarily subjected to lateral forces which may damage the piston.

Additionally, the expense of a piston shock absorber unit makes it deficient in many respects. In order to incorporate such a unit, substantial changes must be made to conventional masts or mast bases This presents undue expense—requiring the purchase of both the shock absorber unit and of modified rigs and hardware to employ the unit. Moreover, the relatively complex piston shock absorber is necessarily expensive to manufacture. This presents expense both in the initial purchase and in maintenance, especially in light of the extremely harsh sand and salt water conditions to which sailboard equipment is often subjected. Finally, further expense is encountered if the shock absorber unit is fitted with means to adjust the degree of shock absorbency.

In light of the foregoing, it is a primary object of the present invention to provide a shock absorber unit which absorbs substantially all forces exerted by a rig upon a sailboard and may be adjusted to control the amount of shock absorbency.

It is a further object of the present invention to provide a shock absorber unit which is relatively simple in design and inexpensive to manufacture, extremely durable, and may be readily employed with conventional sailboard equipment.

It is an additional object of the present invention to provide a shock absorber unit which also serves as a more durable and reliable universal joint for a sailboard.

SUMMARY OF THE INVENTION

The present invention is an improved universal joint for sailboards which absorbs detrimental vertical forces generated during sailing in rough water.

The present invention is a universal joint which comprises a sealed pressurized chamber with rigid top and bottom end caps and flexible side walls. Threaded holes are provided in the end caps which permit the universal joint to be readily substituted for existing universal joints without modification of other sailboard equipment. Valve means may be provided to adjust the pressure within the chamber.

In operation, the sidewall of the universal joint flexes to absorb the vertical forces—thus maintaining the trim of the sails and avoiding subjecting the board to deflection. The nature of the present invention allows it to absorb even forces which are not perpendicular to the axis of the mast and universal joint. As is required of all sailboard universal joints, the joint of the present invention also will fold perpendicularly to permit the rig to collapse flush with the water.

The present invention provides a shock absorber unit which is effective, durable and straightforward to employ. Additionally, the present invention provides an improved universal joint which is believed to be more reliable than existing units.

DESCRIPTION OF THE DRAWINGS

FIG. 1 is a three-quarter view of a conventional sailboard employing the present invention;

FIG. 3 is a sectional view of the present invention along line 3—3 of FIG. 2;

FIG. 4 is a sectional view of the universal joint of the present invention with the universal joint's side walls flexing to absorb vertical forces;

FIG. 5 is a sectional view of the universal joint of the present invention with the joint bent perpendicularly;

FIG. 6 is a sectional view of another embodiment of the present invention; and FIG. 7 is a sectional view of the embodiment of FIG. 1 with the joint bent perpendicularly.

DETAILED DESCRIPTION OF THE INVENTION

Figure 2:
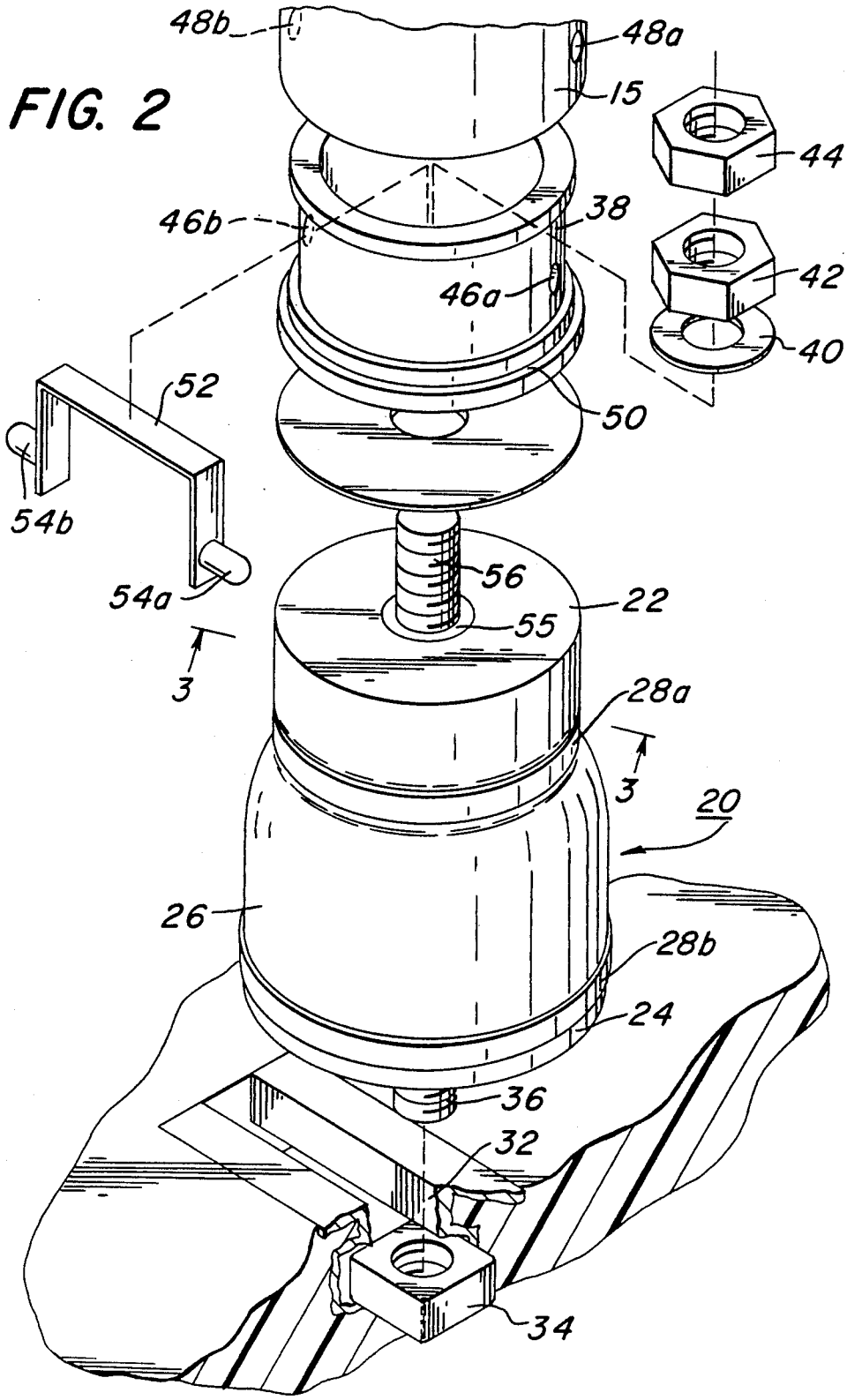
FIG. 2 is an elevated view of the universal joint of the present invention shown in exploded orientation with conventional sailboard equipment.

The present invention provides an improved universal joint for a sailboard which is simultaneously more durable than conventional universal joints and can absorb detrimental vertical forces encountered in choppy water or during jumps.

Shown in FIG. 1 is a conventional sailboard 10 employing the present invention, which comprises a board 12, a mast 14, a mast base 15, a boom 16, a sail 18, and a universal joint 20. The entire collection of hardware above the board 12 is collectively referred to as the rig 21. It should be understood that it is the present invention's intent to use the term "sailboard" to denote all forms of "free sail" devices, including sailboards, sail-skateboards, sail-snowboards, and sail ice-boards. The present invention is believed to provide equally beneficial applications in all forms of free-sail crafts. The universal joint 20 flexibly mounts the rig 21 to the board 12 while permitting the rig 21 to rotate a full 360° with respect to the board 12. Prior to a sailor mounting the sailboard 10, the rig 21 folds along the universal joint 20 and lays flat in the water (i.e. the axis of the mast 14 is oriented parallel to the plane of the board 12). While sailing, the mast 14 is oriented in various positions substantially perpendicular to the board 12.

Shown in FIGS. 2 and 3 is the universal joint 20 of the present invention. The universal joint 20 comprises a top surface 22, a bottom surface 24, and a flexible side wall 26. In the preferred embodiment, the top surface 22 and bottom surface 24 are each substantially cylindrical caps, as shown. These caps may be constructed of any strong, rigid material, such as stainless steel or reinforced plastic.

The side wall 26 is anchored to the top surface 22 and bottom surface 24 through use of clamping rings 28*a* and 28*b*, respectively. The clamping rings 28*a* and 28*b* encircle the top and bottom surfaces and the side wall 26 and snugly retain the sidewall 26 against the surfaces 22 and 24. The effect is to create a completely contained air tight interior 30 within the side wall 26. A glue or sealant may also be employed to increase the anchorage and air tightness between the side wall 26 and the top surface 22 and bottom surface 24.

Also shown in FIG. 2 are examples of conventional hardware used in conjunction with sailboard universal joints. Shown in FIG. 2 is a conventional "short board" sailboard which includes a slot 32 in the board 12 which provides access to a T-nut 34. The slot 32 and T-nut 34 permit the universal joint to be connected at different positions along the board 12 as is appropriate given different wind and water conditions and various rigging. A conventional universal joint is provided with a threaded hole which receives a threaded stud which in turn anchors the joint securely against the board 12 in the appropriate position. A tab or lever is often attached to the joint to help tighten or loosen the joint as required.

In order to be completely compatible with this method of anchorage, the universal joint 20 of the present invention may be provided with a threaded hole within the bottom surface 24 of the joint to receive threaded stud 36. This permits the joint 20 to be handled and anchored like a conventional universal joint. An additional benefit of the present invention, however, is that the larger circumference of the joint 20 makes it very easy to loosen and tighten—which may avoid a need for a tab or lever.

Similarly, a conventional universal joint is often provided with a threaded hole in its top surface to anchor to a threaded stud which in turn attaches to means to attach the mast 14. Shown in FIG. 2 is one such attachment which includes a base cup 38, a washer 40 and nuts 42 and 44 for threading onto a universal joint's top stud. The mast cup 38 is provided with two holes 46*a* and 46*b* which correspond to holes 48*a* and 48*b* in the mast base 15. The mast base 15 mounts against the base cup 38 up to an annular shoulder 50. The mast base 15 is held in position by a spring pin 52 which contains studs 54*a* and 54*b* which passes through holes 46*a* and 48*a*, and 46*b* and 48*b*, respectively. As is known, the mast 14 is then attached to the mast base 15 in a conventional manner.

The present invention is readily adaptable to use with this mounting means by providing a threaded hole 55 within the top surface 22 of the joint 20 which receives a threaded stud 56. In this manner the present invention mounts as a conventional universal joint, but it provides vast improvements over such available products.

As is shown in FIG. 4, the universal joint 20 of the present invention is capable of absorbing the substantially vertical forces generated by the rig 21 relative to the board 12. When such an impact is delivered to the joint 20, the side wall 26 flexes outwardly and/or downwardly and, in conjunction with air pressure within the interior 30, the joint 20 absorbs these detrimental forces. As should be evident from this description, this form of shock absorber unit absorbs a full array of forces generated by the rig 21 during sailing—even if the downward forces are generated when the mast 14 is far from perpendicular to the board 12.

Although not considered crucial to the basic operation of the present invention, the joint 20 may be provided with valve means, such as a threaded opening 58 and a threaded bolt 60, which allows the user to adjust the amount of air pressure within the interior 30. The valve means may be located anywhere on the joint 20, but it is preferred to have it readily accessible, as shown, to allow adjustment of the pressure without disassembling the sailboard rigging. As the water gets rougher, more pressure may be desired in the joint 20 to withstand greater impact forces due to "chop" and the extreme forces generated in jumps. A stop valve and an air pump may also be provided to further fine-tune the shock absorbency of the universal joint 20. The preferred air pressure of the interior for most applications is atmospheric pressure. This may be increased under heavier conditions or decreased in lighter breezes.

Shown in FIG. 5 is the universal joint 20 of the present invention folded perpendicularly—allowing the rig 21 to lay flat in the water. If provided with valve means to adjust internal pressure, it is important that the universal joint 20 is not over inflated so that the joint 20 will not bend at least a full ninety degrees (90°). Over inflation may be avoided if the joint 20 is inflated while the mast 14 is parallel to the plane of the board 12.

The side wall 26 may be constructed of any durable material which provides the desired flexibility both outwardly, when absorbing pressure against the top surface 22, and perpendicularly, when hinging the mast 14. It has been found that two ply fabric reinforced rubber provides the necessary flexibility and durability. One commercially available form of this material is in an Airmount® isolator, such as a model No.1M1A-0, available from Firestone Industrial Products Company of Noblesville, Ind. This material when used in conjunction with the present invention not only provides all the benefits of the present invention, it also provides a more durable universal joint than those presently employed. It should be appreciated that any suitable pressure tight and flexible material may be substituted so long as it provides the necessary flexibility and durability. Such materials, commonly referred to as "elastomers" may include natural rubber, ethylene propylene, pleuro-elastomer, and urethane. It is believed to be beneficial to back such materials with flexible fabric or "cord" such as nylon, Mylar®, Kevlar®, or other suitable material. Notwithstanding the improved durability, the present invention may still be employed with a slightly enlarged "joint saver" reinforcing strap (not shown) to assure no separation of rig 21 and board 12 in the event of joint failure.

FIG. 6 shows another embodiment of the present invention. In this embodiment the top cap 22*a* is modified to be the same circumference as the bottom cap 24*a*. A cup shaped side wall 26*a* is provided. The caps 22*a* and 24*a* are bent to surround the side wall 26*a* and create airtight seams 60 and 62. If the caps are constructed of stainless steel or similar material, as shown, the threaded holes 64 and 66 are welded into the center of caps 22*a* and 24*a*, respectively. An elastomer bumper (not shown) may be provided surrounding threaded hole 64 to prevent damage within the joint 20. FIG. 7 shows this joint in a bent orientation.

The present invention provides an effective means of absorbing detrimental substantially vertical forces generated during board sailing in rough water or along other rough surfaces. The universal joint 20 is straightforward in construction, requires little or no modification of existing sailboard equipment, and is extremely durable. The durability of the present invention also makes it a highly viable alternative to existing universal joints.

Although particular embodiments of the present invention are disclosed herein, it is not intended to limit the invention to such a disclosure and changes and modifications may be incorporated and embodied within the scope of the following claims.

What is claimed is:

1. In an apparatus for attaching a sailboard mast to a sailboard which includes a universal joint, means to attach said mast to said universal joint, and means to attach said universal joint to said sailboard, the improvement which comprises:

a hollow universal joint having a top surface, an opposing bottom surface, a flexible side wall extending between the top and bottom surfaces, and an airtight sealed interior;

wherein said side wall is adapted to flex to absorb impact force upon the joint's top or bottom surface, and to bend to position said top surface substantially perpendicular to said bottom surface.

2. The apparatus of claim 1 wherein said airtight interior is capable of maintaining various internal pressures and the apparatus includes means to adjust the pressure within said interior.

3. The apparatus of claim 2 wherein said means to adjust the pressure within said interior is a valve communicating between the interior and exterior of said joint.

4. The apparatus of claim 3 wherein said valve comprises a threaded opening sealed with a removable threaded bolt.

5. The apparatus of claim 3 wherein said valve passes through the top surface.

6. The apparatus of claim 2 wherein the degree of impact force absorption of said universal joint is controlled by adjusting the pressure within the interior of said joint.

7. The apparatus of claim 1 wherein said means to attach said universal joint to said sailboard includes a threaded stud attached to the bottom surface of said universal joint.

8. The apparatus of claim 1 wherein said means to attach said mast to said universal joint includes a threaded stud attached to the top surface of said universal joint.

9. The apparatus of claim 8 wherein said means to attach said mast to said universal joint includes a base cup attached to said threaded stud and adapted to receive a mast base, which base in turn attaches to the mast, and at least one spring pin which passes through a hole in said base cup and a hole in said mast base to retain the base attached to the base cup.

10. The apparatus of claim 1 wherein said side wall comprises at least one layer of elastomer reinforced with fabric.

11. The apparatus of claim 1 wherein said bottom surface is a rigid, substantially cylindrical base.

12. The apparatus of claim 11 wherein said side wall is affixed to said cylindrical base by means which includes a clamp ring which snugly surrounds said base and said side wall and creates an airtight seal between said side wall and said base.

13. The apparatus of claim 1 wherein said top surface is a rigid, substantially cylindrical cap.

14. The apparatus of claim 13 wherein said side wall is affixed to said cylindrical cap by means which includes a clamp ring which snugly surrounds said cap and said wall and creates an airtight seal between said side wall and said cap.

15. A universal joint for attaching a rig, including a mast, to a sailboard while permitting the axis of said mast to be positioned at any angle from perpendicular to parallel to the plane of the sailboard, which universal joint comprises a top surface having means to attach to a mast cup which in turn attaches said mast to said universal joint;

a bottom surface having means to attach to said board; and a flexible side wall which is affixed between said top and bottom surfaces and defines a hollow pressurizable interior within said top and bottom surfaces and said side walls;

wherein said side wall flexes to absorb force exerted against the top or bottom surface of said joint.

16. The universal joint of claim 15 wherein valve means are provided to adjust the pressure of said interior to control the amount of force absorbed by said joint.

17. The universal joint of claim 16 wherein said top surface comprises a substantially cylindrical cap;

said bottom surface comprises a substantially cylindrical base; and wherein said side wall is affixed to said base by a substantially circular clamping ring which encircles said base and creates an airtight seal between said base and side wall.

18. The universal joint of claim 17 wherein said side wall is affixed to said cap by a substantially circular clamping ring which encircles said cap and creates an airtight seal between said cap and side wall.

19. The universal joint of claim 18 wherein said side wall comprises a cylinder of reinforced elastomer.

20. A universal joint for attaching a rig, including a mast, to a sailboard while permitting the axis of said mast to be positioned at any angle from perpendicular to parallel to the plane of the sailboard, which universal joint comprises a top surface having means to attach to a mast cup which in turn attaches said mast to said universal joint;

a bottom surface having means to attach to said board; and a flexible side wall which is affixed between said top and bottom surfaces and creates a pressurizable interior within said top and bottom surfaces and said side walls;

wherein said side walls flexes to absorb force exerted against the top or bottom surface of said joint; and wherein said universal joint includes means to adjust the pressure of the interior to control the amount of force absorbed by the joint.

* * * * *